US009573264B2

(12) United States Patent
Schaal et al.

(10) Patent No.: US 9,573,264 B2
(45) Date of Patent: Feb. 21, 2017

(54) HANDHELD POWER TOOL

(75) Inventors: Thorsten Schaal, Frankfurt (DE); Ralf Windsheimer, Stuttgart (DE); Jens Blum, Filderstadt (DE); Heiko Roehm, Stuttgart (DE); Tobias Herr, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 79 days.

(21) Appl. No.: 12/926,912

(22) Filed: Dec. 17, 2010

(65) Prior Publication Data

US 2011/0147021 A1 Jun. 23, 2011

(30) Foreign Application Priority Data

Dec. 18, 2009 (DE) ..... 10 2009 054 927

(51) Int. Cl.
*B25B 21/00* (2006.01)
*B25F 5/00* (2006.01)
*B25D 16/00* (2006.01)

(52) U.S. Cl.
CPC ..... *B25F 5/001* (2013.01); *B25D 16/00* (2013.01); *B25D 2250/255* (2013.01)

(58) Field of Classification Search
CPC B25F 5/001; B25B 21/008; F16H 2200/2035; B25D 16/006
USPC ..... 173/1–178
See application file for complete search history.

(56) References Cited

U.S. PATENT DOCUMENTS

| | | | | |
|---|---|---|---|---|
| 3,274,631 | A * | 9/1966 | Spohr | 15/22.1 |
| 4,060,723 | A * | 11/1977 | Nelson | 362/205 |
| 4,592,144 | A * | 6/1986 | Tolbert et al. | 30/394 |
| 4,823,885 | A | 4/1989 | Okumura | |
| 4,825,961 | A * | 5/1989 | Neumaier et al. | 173/109 |
| 5,343,961 | A | 9/1994 | Ichikawa | |
| 5,951,026 | A * | 9/1999 | Harman et al. | 279/143 |
| 6,086,502 | A * | 7/2000 | Chung | 475/299 |
| 6,186,709 | B1 * | 2/2001 | Hsu | 408/241 R |
| 6,380,502 | B1 * | 4/2002 | Hirschburger et al. | 200/548 |
| 6,655,470 | B1 * | 12/2003 | Chen | 173/47 |
| 6,860,341 | B2 * | 3/2005 | Spielmann et al. | 173/216 |
| 7,021,400 | B2 * | 4/2006 | Oretti | 173/29 |
| 7,028,784 | B2 * | 4/2006 | Breitenmoser | 173/20 |
| 7,044,882 | B2 * | 5/2006 | Eisenhardt | 475/298 |
| 7,513,845 | B2 * | 4/2009 | Ho | 475/298 |
| 7,690,658 | B2 * | 4/2010 | Puzio et al. | 279/60 |

(Continued)

FOREIGN PATENT DOCUMENTS

| | | |
|---|---|---|
| CN | 1411958 | 4/2003 |
| DE | 4441793 A1 | 5/1996 |

(Continued)

*Primary Examiner* — Robert Long
(74) *Attorney, Agent, or Firm* — Gerard Messina

(57) ABSTRACT

The invention is based on a handheld power tool, in particular a cordless handheld power tool, having a gear unit and having a switch device for switching the gear unit. The switch device is provided with at least one user-control switch element, and at least one retaining element that is provided for acting on the user-control switch element in at least one position of the user-control switch element, with a force in the direction of at least one switch position, or for keeping the user-control switch element in at least one switch position. According to the invention, the retaining element is secured to a gear element of the gear unit.

19 Claims, 3 Drawing Sheets

(56) References Cited

U.S. PATENT DOCUMENTS

| | | | | |
|---|---|---|---|---|
| 7,900,715 | B2 * | 3/2011 | Chen | 173/183 |
| 7,980,324 | B2 * | 7/2011 | Bixler et al. | 173/176 |
| 8,075,229 | B2 * | 12/2011 | Mok et al. | 408/124 |
| 8,172,004 | B2 * | 5/2012 | Ho | 173/176 |
| 8,205,685 | B2 * | 6/2012 | Bixler et al. | 173/176 |
| 8,545,363 | B2 * | 10/2013 | Roehm et al. | 475/299 |
| 2007/0181319 | A1 * | 8/2007 | Whitmine et al. | 173/48 |
| 2009/0003950 | A1 * | 1/2009 | Mok et al. | 408/240 |
| 2009/0065227 | A1 | 3/2009 | Lin | |
| 2009/0098971 | A1 * | 4/2009 | Ho et al. | 475/153 |
| 2010/0071923 | A1 * | 3/2010 | Rudolph et al. | 173/48 |
| 2010/0163261 | A1 * | 7/2010 | Tomayko | B23B 45/008 173/47 |
| 2010/0193206 | A1 * | 8/2010 | Teng | 173/48 |

FOREIGN PATENT DOCUMENTS

| | | | | |
|---|---|---|---|---|
| EP | 1506847 | A1 | 2/2005 | |
| EP | 1524083 | A1 | 4/2005 | |
| EP | 2184138 | A2 | 5/2010 | |
| WO | WO 2004085118 | A1 * | 10/2004 | B25D 16/00 |

* cited by examiner

HANDHELD POWER TOOL

CROSS-REFERENCE TO RELATED APPLICATION

This application is based on German Patent Application 10 2009 054 927.7 filed on Dec. 18, 2009.

BACKGROUND OF THE INVENTION

Field of the Invention

A cordless handheld power tool is already known which has a planetary gear unit and a switch device for switching the planetary gear unit. The switch device has a user-control switch element, formed by a slide, and a retaining element that is provided for acting, in at least one position of the user-control switch element, with a force on the user-control switch element in the direction of at least one switch position. The retaining element is secured to the user-control switch element by means of a welded connection.

Description of the Prior Art

The invention is based on a handheld power tool, in particular a cordless handheld power tool, having a gear unit and having a switch device for switching the gear unit, which switch device has at least one user-control switch element and at least one retaining element that is provided for acting on the user-control switch element, in at least one position of the user-control switch element, with a force in the direction of at least one switch position, or for keeping the user-control switch element in at least one switch position.

SUMMARY OF THE INVENTION

It is provided that the retaining element is secured to a gear element of the gear unit. The term "user-control switch element" should be understood in particular to mean an element that is intentionally provided for being actuated directly by a user for performing a switching procedure. Preferably, the user-control switch element is formed by a rotary knob, or especially advantageously by a slide. The term "retaining element" should be understood in particular to mean an element which is provided for avoiding an unwanted motion of the user-control switch element, during operation of the handheld power tool, out of a switch position, and/or that is advantageously provided for guiding the user-control switch element, beginning in at least one position, into a switch position automatically, in particular by means of a tensioning force. The term "gear element" should be understood in particular to mean an element which is provided for boosting and/or reducing and/or diverting force, and/or a gearbox. The term "gearbox" should be understood in particular to mean a housing, embodied separately from an outer housing, and in particular a housing that is at least partly surrounded by the outer housing. Moreover, the term "securing" in this connection should be understood in particular to mean that a bearing force of the retaining element is braced in a gear element via the gear element, and/or that the retaining element is secured directly to the gear element by means of at least one securing element. By means of a suitable embodiment, an advantageously simple and especially stable securing of the retaining element can be attained, specifically especially when the gear element is formed by a gear wheel. Thus a component designed from the outset for withstanding strong forces can advantageously be employed.

It is also proposed that the gear element is disposed in a manner fixed against relative rotation. The term "disposed in a manner fixed against relative rotation" should be understood in particular to mean that the gear element is disposed as fixed against relative rotation with respect to a housing, such as a gearbox in particular. A suitable design makes it possible to avoid unwanted motion of the retaining element during operation. The gear element is especially advantageously formed by a ring gear.

If the retaining element is secured to the gear element by at least one securing element with which the gear element is secured to some further element, for instance especially preferably to a gearbox, then economies can be achieved in terms of additional components, weight, assembly effort, and costs. The retaining element can be secured to the gear element by way of various securing elements that appear appropriate to one skilled in the art, such as a detent element and/or especially advantageously a screw element, and as a result, an especially simple, secure connection be attained.

In a further feature of the invention, it is proposed that the retaining element is provided for urging the user-control switch element in the direction of at least two different switch positions, as a result of which economies can be attained in terms of additional components, space, weight, assembly effort, and costs. Alternatively, it is fundamentally also possible to provide a plurality of retaining elements, which are provided for urging the user-control switch element in the direction of different switch positions. Preferably, urging the user-control switch element in the direction of at least two switch positions is achieved by means of a detent hump that is disposed preferably on the retaining element and/or on an element corresponding to the retaining element. The retaining element can be formed from various materials that appear appropriate to one skilled in the art; however, advantageously, the retaining element is produced from spring steel and especially advantageously from a spring steel sheet.

It is also proposed that the retaining element is provided for embodying a switching range of the user-control switch element between the switch positions as at least essentially unstable. The phrase "at least essentially unstable" should be understood in particular to mean that between the switch positions, a partial actuation path or a partial actuation angle in which the user-control switch element is kept in a stable position without external forces is shorter than 2 mm and preferably shorter than 1 mm, or smaller than 2° and preferably smaller than 1°. The term "partial actuation path" should be understood in particular to mean a part of a path along which the user-control switch element, on switching, is moved from one switch position to another, and the term "partial actuation angle" should be understood in particular to mean a part of an angle by which the user-control switch element is moved upon switching from one switch position to another. By means of this kind of design, it is possible at least largely to prevent the user-control switch element from remaining in an unwanted intermediate position. A correspondingly unstable embodiment can be achieved by various means that appear appropriate to one skilled in the art, but especially advantageously with two corresponding detent humps.

If the gear unit includes a gearbox, which has at least one stop for the user-control switch element, a limitation of motion of the user-control switch element can be achieved at least largely independently of a handheld power tool housing that is embodied as at least partly separate from the gearbox and in particular that at least partly surrounds the gearbox. The stop can be formed by a component secured to the gearbox, but especially advantageously, the stop is formed integrally onto the gearbox, as a result of which economies in terms of additional components, assembly effort and costs can be attained.

If the switch device has a switch element, which cooperates with a gear element and is secured to the user-control switch element by means of at least one securing element, an especially simple assembly can be achieved, especially if the switch element is secured to the user-control switch element by means of at least one detent connection.

If the switch element is formed at least in part by a wire element, this element can advantageously be integrated in a space-saving way. The term "wire element" should be understood in particular to mean an element whose length, viewed in an unbent, straight orientation, is at least 5 times, and preferably at least 10 times, as great as its thickness, and which preferably has a round cross section.

BRIEF DESCRIPTION OF THE DRAWINGS

The invention will be better understood and further objects and advantages thereof will become more apparent from the ensuing detailed description of a preferred embodiment taken in conjunction with the drawings, in which.

DESCRIPTION OF THE PREFERRED EMBODIMENT

Figure 1:
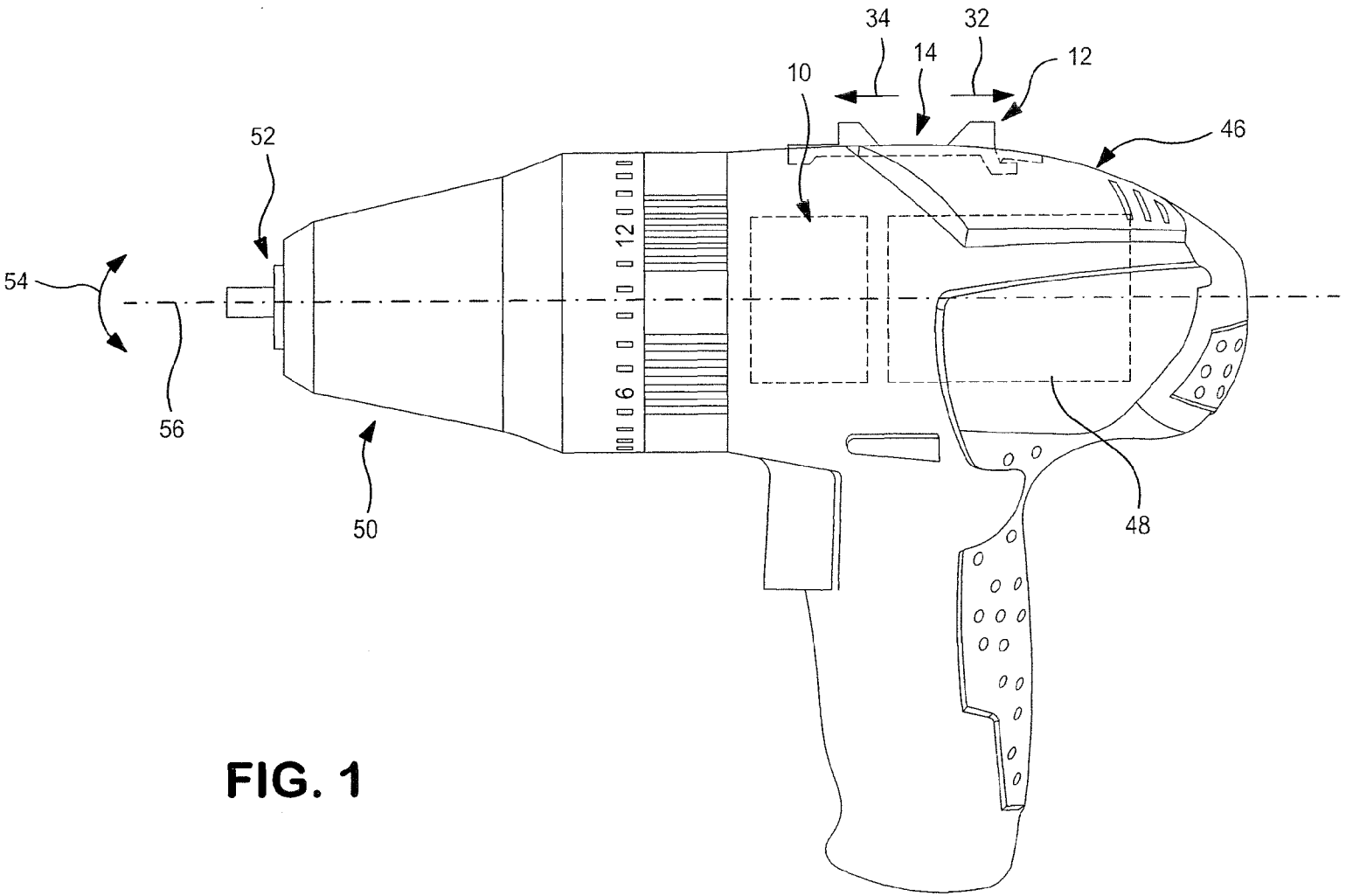
FIG. 1 shows a handheld power tool of the invention.

FIG. 1 schematically shows a handheld power tool, including a cordless combined power impact drill and power screwdriver, with a drive motor 48 which is disposed in a power tool housing 46 and with which, via a gear unit 10 not shown in detail, a driven shaft of a driven unit can be driven. A tool chuck 50 is secured to the driven shaft. The tool chuck 50 has a clamping device 52, which can be actuated for securing a tool in the direction of rotation 54 about an axis 56 of rotation of the driven unit relative to the power tool housing 46.

The gear unit 10 is formed by a multi-stage, shiftable planetary gear. The handheld power tool has a switch device 12 for manually switching the gear unit 10, which has a user-control switch element 14 formed by a slide. The user-control switch element 14 is supported on an upper side of the handheld power tool translationally displaceably, parallel to the axis 56 of rotation. The switch device 12 furthermore has a retaining element 16, formed by a spring steel sheet, which is provided for urging the user-control switch element 14 with a respective force 18, 20 in the direction 32, 34 of two different switch positions 22, 24, and for keeping the user-control switch element 14 in the switch positions 22, 24.

The retaining element 16 is secured to a gear element 26 of the gear element 10, which element is formed by a gear wheel, specifically a ring gear. The retaining element 16 is secured to the gear element 26 by securing elements 28, formed by screws, with which the gear element 26 is secured to a further element 30, specifically to a gearbox of the gear unit 10. The gearbox is embodied separately from the power tool housing 46 and is surrounded by it. The gear element 26 is disposed in a manner fixed against relative rotation; that is, by means of the securing elements 28, the gear element 26 is joined to the further element 30 or to the gearbox in a manner fixed against relative rotation. The securing elements 28 are guided or screwed in (FIG. 3), parallel to the axis 56 of rotation, through recesses 62 in the retaining element 16 and through recesses 64 in the gear element 26, into recesses, provided with a female thread, or the element 30 or gearbox. By means of the securing elements 28, the retaining element 16 is pressed against the gear element 26 and is thus secured in force- and form-locking fashion to the gear element 26, specifically on a side of the gear element 26 facing away from the tool chuck 50. However, it would fundamentally also be conceivable for the retaining element 16 to be secured directly to the gearbox.

Figure 2:
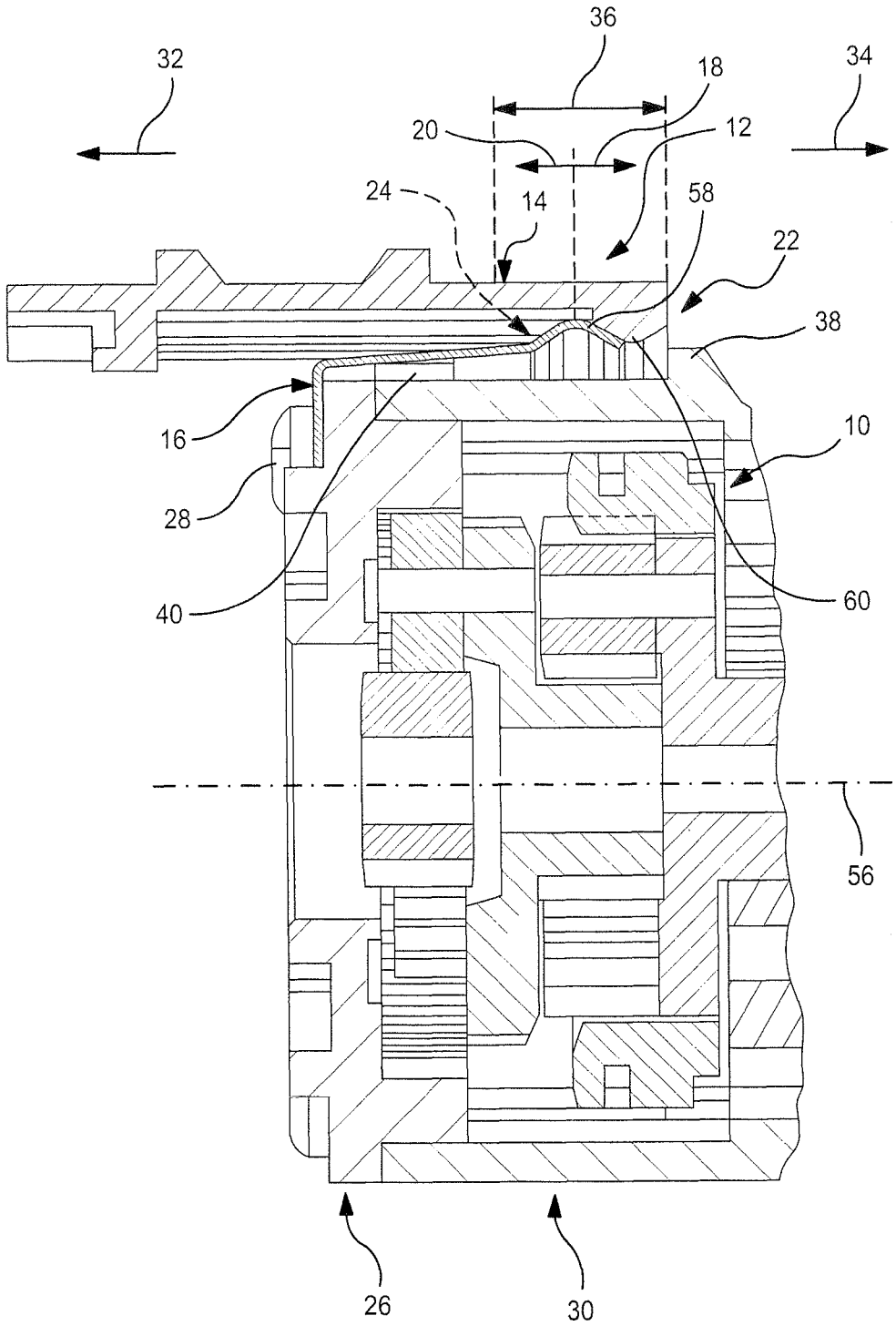
FIG. 2 shows a detail of a longitudinal section through the handheld power tool of FIG. 1.
Figure 3:
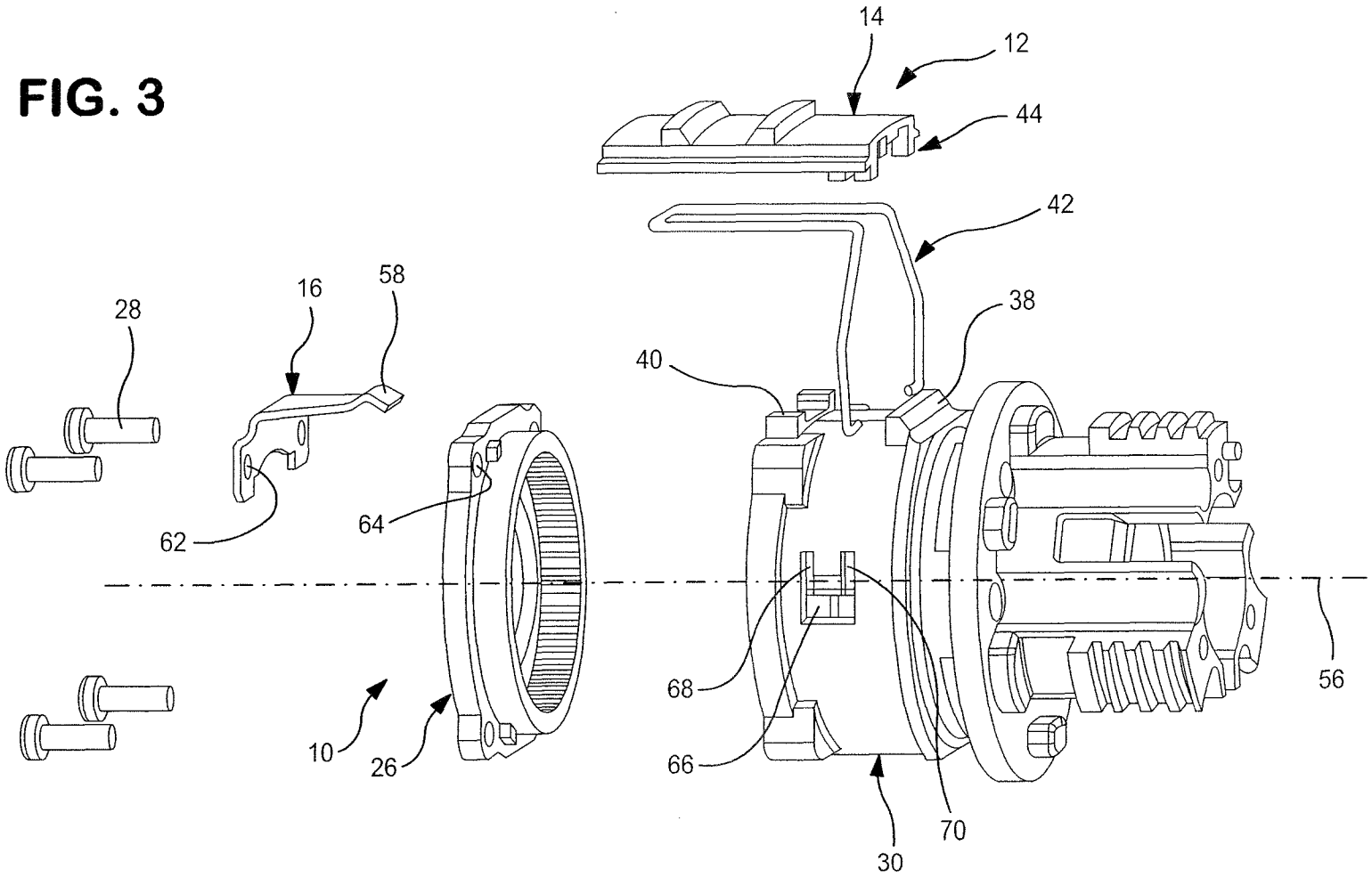
FIG. 3 shows individual parts in an exploded view of the handheld power tool of FIG. 1.

The retaining element 16 has a detent hump 58, which cooperates with a detent hump 60 of the user-control switch element 14 (FIGS. 2 and 3). The detent hump 58 is formed integrally onto the retaining element 16. The user-control switch element 14 is formed by a plastic part, onto which the detent hump 60 is integrally formed. The retaining element 16 is provided for embodying a switching range 36 of the user-control switch element 14 between the switch positions 22, 24 as unstable. Over the entire switching range 36, which is formed by a path along which the user-control switch element 14 moves on being switched from one of the switch positions 22 or 24 to the other switch position 24 or 22, respectively, the detent humps 58, 60 are always in contact with one another. Moreover, the detent humps 58, 60 are free of a flattened face extending parallel to the direction of switching motion of the user-control switch element. The term "free of a flattened face" should be understood to mean that the detent humps 58, 60 have no face, or only one face, extending parallel to the switching motion direction of the user-control switch element, that has a length in the switching motion direction of the user-control switch element 14 of less than 1 mm. In a motion of the user-control switch element 14 from the switch position 22 to the switch position 24, the retaining element 16 is elastically deflected inward in the radial direction toward the axis 56 of rotation. By means of the retaining element 16, the user-control switch element 14 is urged by the force 18 in the direction 34 of the switch position 22, counter to the motion direction, until the detent humps 58, 60 each come into contact with one another with their tallest portions, or are located one above the other. Next, the user-control switch element 14 is urged by the retaining element 16 with the force 20 in the direction 32 of switch position 24. When the user-control switch element 14 moves from the switch position 24 to the switch position 22, the introductions of force are correspondingly in the reverse order. The forces 18, 20 acting in the directions 32, 34 are due to the cooperation of the oblique faces of the detent humps 58, 60. When a switch takes place from the switch position 22 to the switch position 24, and vice versa, the retaining element 16, in cooperation with the user-control switch element 14, generates an audible clicking sound that tells the user that a switching procedure has been performed.

In the switch position 22, the user-control switch element 14 is limited in the direction 34 by a stop 38 disposed on the gearbox, and in the switch position 24, the user-control switch element 14 is limited in the direction 32 by a stop 40 disposed on the gearbox. The stops 38, 40 are each integrally formed onto the gearbox. In the switch position 22, the user-control switch element 14 is pressed against the stop 38 by means of the retaining element 16, and in the switch position 24, the user-control switch element 14 is pressed against the stop 40 by means of the retaining element 16, and thus is kept and secured in the respective switch position 22 and 24.

The switch device 12 furthermore has a switch element 42, which cooperates with a gear element, specifically with a gear wheel, and which is secured to the user-control switch element 14 by means of securing elements 44. The securing elements 44 are formed by detent elements, which are disposed on the user-control switch element 14 and into which the switch element 42 is snapped. The switch element 42 is formed of a wire element of spring steel and extends through recesses 66 in the gearbox as far as the gear wheel, not shown in detail. By means of the user-control switch element 14 and the switch element 42, a switching force can be exerted by a user on the gear wheel, and the gear wheel can be displaced parallel to the axis 56 of rotation in order to perform a switching procedure. In the vicinity of the recess 66, there are also detent means 68, 70, specifically recesses. In the switch position 22, the switch element 42 is snapped into the detent means 70, and in the switch position 24, the switch element 42 is snapped into the detent means 68. If a motion of the gear wheel is blocked, particularly because of a tooth-on-tooth position, the switch element 42 is elastically deformed. If the blocking, in particular the tooth-on-tooth position, is undone, then the gear wheel is switched automatically as a result of a tensioning force stored in the switch element 42.

The foregoing relates to a preferred exemplary embodiment of the invention, it being understood that other variants and embodiments thereof are possible within the spirit and scope of the invention, the latter being defined by the appended claims.

We claim:

1. A handheld power tool, comprising:

a drive motor disposed in a housing;

a gear unit;

an output shaft having a tool holder, wherein the output shaft is driven by the drive motor via the gear unit;

a switch device for switching the gear unit, the switch device comprising:

at least one first switch element embodied as a user-control switch element;

at least one second switch element that is secured to the first switch element by at least one first securing element, the second switch element engaged with an axially displaceable gear wheel of the gear unit; and at least one retaining element that is configured for acting on the first switch element in at least one position of the first switch element, with a force in the direction of at least one switch position, or for keeping the first switch element in at least one switch position;

wherein the retaining element is fixedly secured to a gear element of the gear unit, the gear element being disposed in a manner fixed against axial displacement and rotation relative to the housing.

2. The handheld power tool as defined by claim 1, wherein the retaining element is secured to the gear element by at least one second securing element with which the gear element is secured to a further element.

3. The handheld power tool as defined by claim 1, wherein the gear element is formed at least in part by the gear wheel.

4. The handheld power tool as defined by claim 2, wherein the gear element is formed at least in part by the gear wheel.

5. The handheld power tool as defined by claim 1, wherein the retaining element is secured to the gear element via at least one screw element.

6. The handheld power tool as defined by claim 2, wherein the retaining element is secured to the gear element via at least one screw element.

7. The handheld power tool as defined by claim 3, wherein the retaining element is secured to the gear element via at least one screw element.

8. The handheld power tool as defined by claim 1, wherein the retaining element is provided for urging the user-control switch element in the direction of at least two different switch positions.

9. The handheld power tool as defined by claim 8, wherein the retaining element has a switching range of the user-control switch element between the switch positions, wherein a detent element on the retaining element is configured to contact a detent element of the user-control switch element, and wherein the switching range between the detent elements is unstable.

10. The handheld power tool as defined by claim 1, wherein the gear unit includes a gearbox, which has at least one stop for the user-control switch element.

11. The handheld power tool as defined by claim 9, wherein the gear unit includes a gearbox, which has at least one stop for the user-control switch element.

12. The handheld power tool as defined by claim 1, wherein the second switch element is formed at least in part by a wire element.

13. The handheld power tool as defined by claim 1, wherein the user-control switch element is translationally displaceable parallel to an axis of rotation of the power tool.

14. The handheld power tool as defined by claim 1, wherein the gear element is formed by a ring gear.

15. The handheld power tool as defined by claim 2, wherein the further element is a gearbox of the gear unit.

16. The handheld power tool as defined by claim 1, wherein the retaining element is secured to the gearbox.

17. The handheld power tool as defined by claim 1, wherein the retaining element has a detent element configured to cooperate with a detent element of the user-control switch element.

18. The handheld power tool as defined by claim 1, wherein the user-control switch element and the second switch element are configured to exert a switching force on the gear wheel such that the gear wheel is displaced parallel to an axis of rotation of the power tool.

19. A handheld power tool, comprising:

a drive motor disposed in a housing;

a gear unit;

an output shaft having a tool holder, wherein the output shaft is driven by the drive motor via the gear unit; and a switch device for switching the gear unit, the switch device having at least one user-control switch element and at least one retaining element that is configured to contact the user-control switch element in at least one position of the user-control switch element and having a tensioning force in the direction of at least one switch position, or to keep the user-control switch element in at least one switch position by the tensioning force preventing unwanted motion of the user-control switch element;

wherein the retaining element is fixedly secured to a gear element of the gear unit, the gear element being disposed in a manner fixed against axial displacement and rotation relative to the housing.

* * * * *